US005186708A

United States Patent [19]

Stroucken et al.

[11] Patent Number: 5,186,708

[45] Date of Patent: Feb. 16, 1993

[54] CENTRIFUGAL SEPARATOR HAVING A ROTOR BODY WITH A MOVABLE WALL

[75] Inventors: Klaus Stroucken, Rönninge; Rolf Ridderstrale, Stockholm, both of Sweden

[73] Assignee: Alfa-Lavel Separation AB, Tumba, Sweden

[21] Appl. No.: 721,614

[22] PCT Filed: Nov. 7, 1990

[86] PCT No.: PCT/SE90/00722

§ 371 Date: Jun. 28, 1991

§ 102(e) Date: Jun. 28, 1991

[87] PCT Pub. No.: WO91/08054

PCT Pub. Date: Jun. 13, 1991

[30] Foreign Application Priority Data

Nov. 27, 1989 [SE] Sweden ..... 8903988

[51] Int. Cl.[5] ..... B04B 1/08; B04B 7/08

[52] U.S. Cl. ..... 494/41; 494/48; 494/64; 494/70

[58] Field of Search ..... 494/38, 41, 47, 48, 494/64, 81, 67-73, 85, 43; 210/360.1, 781, 380.1

[56] References Cited

U.S. PATENT DOCUMENTS

| | | | |
|---|---|---|---|
| 1,343,325 | 6/1920 | Leitch | 494/64 |
| 1,519,629 | 12/1924 | Rohl | 494/70 |
| 1,571,943 | 2/1926 | Hall et al. | 494/27 X |
| 2,898,037 | 8/1959 | Dega | 494/83 X |
| 3,012,710 | 12/1961 | Steinacker | 494/81 X |
| 4,015,773 | 4/1977 | Thylefors | 494/70 X |
| 4,067,494 | 1/1978 | Willus et al. | 494/70 X |
| 4,164,317 | 8/1979 | Nelson | 494/48 X |
| 4,285,462 | 8/1981 | Buffet | 494/48 X |
| 4,871,458 | 10/1989 | Purvey | 210/360.1 |

FOREIGN PATENT DOCUMENTS

| | | | |
|---|---|---|---|
| 217556 | 7/1910 | United Kingdom | 494/70 |
| 221814 | 9/1924 | United Kingdom | 494/81 |
| 2190009 | 11/1987 | United Kingdom | 494/81 |
| 8809216 | 12/1988 | World Int. Prop. O. | 494/81 |

*Primary Examiner*—Harvey C. Hornsby
*Assistant Examiner*—Charles Cooley
*Attorney, Agent, or Firm*—Seidel, Gonda, Lavorgna & Monaco

[57] ABSTRACT

The rotor of a centrifugal separator includes two axially separated end walls and one surrounding wall situated between the end walls. The end walls and a stack of separation discs within the rotor are maintained axially together by a central fastener. The surrounding wall, which is separate from the two end walls, is movable axially during rotor operation relative to at least one of the end walls. The surrounding wall has an inner diameter at the areas where it seals with the ends walls that is smaller than the portions between those sealing areas.

18 Claims, 1 Drawing Sheet

CENTRIFUGAL SEPARATOR HAVING A ROTOR BODY WITH A MOVABLE WALL

BACKGROUND OF THE INVENTION

The present invention relates to a centrifugal separator comprising a rotor body which forms a separation chamber and comprises two axially separated end walls and a surrounding wall situated axially between the end walls, a stack of conical separation discs arranged between the end walls in the separation chamber coaxially with the rotor, and a fastening means separate from the surrounding wall and arranged to keep the end walls and the stack of separation discs therebetween axially together. A centrifugal separator of this kind is described e.g. in U.S. Pat. No. 1,343,325.

As can be seen from U.S. Pat. No. 1,343,325 the two end walls of the known centrifugal separator are kept axially together by means of a central locking joint. This comprises a vertical column permanently connected with the lower end wall and extending centrally through the centrifuge rotor, and a looking ring threaded on to the column and retaining the upper end wall relative thereto. The surrounding wall of the rotor is formed in one piece with the upper end wall and is kept axially in sealing engagement with the lower end wall by means of the central locking joint. Centrifugal separators of this kind were common around the turn of the century when the centrifuge rotors were still relatively small.

When larger centrifuge rotors were developed and higher rotational speeds were used the demands on strength of the central locking joint were increased. As a consequence thereof another type of locking joint was developed. One example of such a locking joint is shown in U.S. Pat. No. 1,571,943. This locking joint comprises a locking ring dimensioned and arranged to keep the rotor end walls axially together in the area of the largest peripheries thereof instead of, as previously, centrally in the rotor. Thus, the locking ring has been given a substantially larger diameter than before, whereby its threads may take up correspondingly larger shearing forces.

A locking joint of the last mentioned type is more difficult to deal with than a central locking joint and, therefore, is not desirable in connection with relatively small centrifuge rotors.

SUMMARY OF THE INVENTION

The object of the present invention is, partly, to enable use of a central locking joint in a centrifuge rotor of the kind here in question and, partly, to make it possible to give such a centrifuge rotor a relatively large diameter and/or a relatively high rotational speed without overloading the central locking joint.

This object may be obtained according to the invention in a centrifugal separator of the initially defined kind in a way such that the surrounding wall is formed separate from both the end walls and arranged to seal against them, that the surrounding wall has a smaller diameter in both the areas, in which it seals against the end walls, than it has in an area axially between these areas, and that the surrounding wall is free to move axially during rotor operation relative to at least one of the end walls in the area of its sealing thereagainst.

By this invention the rotor body may be given a relatively large diameter and/or be given a relatively high rotational speed without the axial forces, by which the rotor body is loaded during rotor operation as a consequence of the overpressure of liquid rotating within the rotor, loading to their full extent the end walls and the central fastening means keeping these together. In other words, the surrounding wall of the rotor body may be shaped in a way such that it takes up, to a desired degree, oppositely directed axially forces from the liquid within the rotor, axial deformation of the rotor body being allowed during operation thanks to the axial movability between the surrounding wall and at least one of the end walls.

In a preferred embodiment of the invention the surrounding wall has substantially the same inner diameter in both the areas in which it seals against the end walls, so that the whole axial pressure exerted by liquid within the rotor against the rotor body radially outside the outer edges of the end walls will be taken up by the surrounding wall during operation of the rotor.

Thanks to the invention, centrifuge rotors having collecting spaces of different sizes radially outside the separation discs, e.g. for separated solids, may be made of end walls and separation discs, respectively, of one and the same size. Only the surrounding walls have to be produced in different sizes which, however, does not influence the size of those forces loading the central locking joints of the rotors during their operation.

For simplifying manual cleaning of a centrifuge rotor according to the invention from separated solids the separate surrounding wall preferably is axially displaceable relative to both of the end walls, so that it can be released from the other parts of the centrifuge rotor without need of separating these parts. The surrounding wall can thus be axially separated from the two end walls while these maintain by means of said fastening means the stack of separation discs in position between the end walls. By giving the surrounding wall a larger diameter in an annular area axially between the areas, in which it is arranged to seal against the end walls, separated solids present in said annular area may be removed from the rotor together with the surrounding wall without any risk of scraping them off against one of the end walls.

DETAILED DESCRIPTION OF THE DRAWINGS

Figure 2:
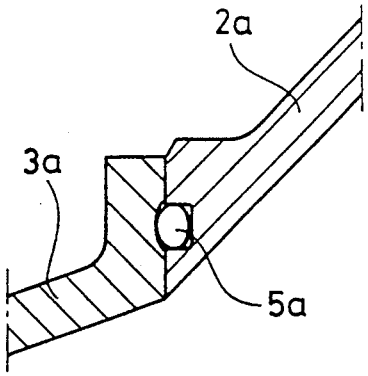
FIG. 2 shows a particular embodiment of a structure for allowing limited axial movement of the surrounding wall of the centrifugal separator relative to the end wall.
Figure 1:
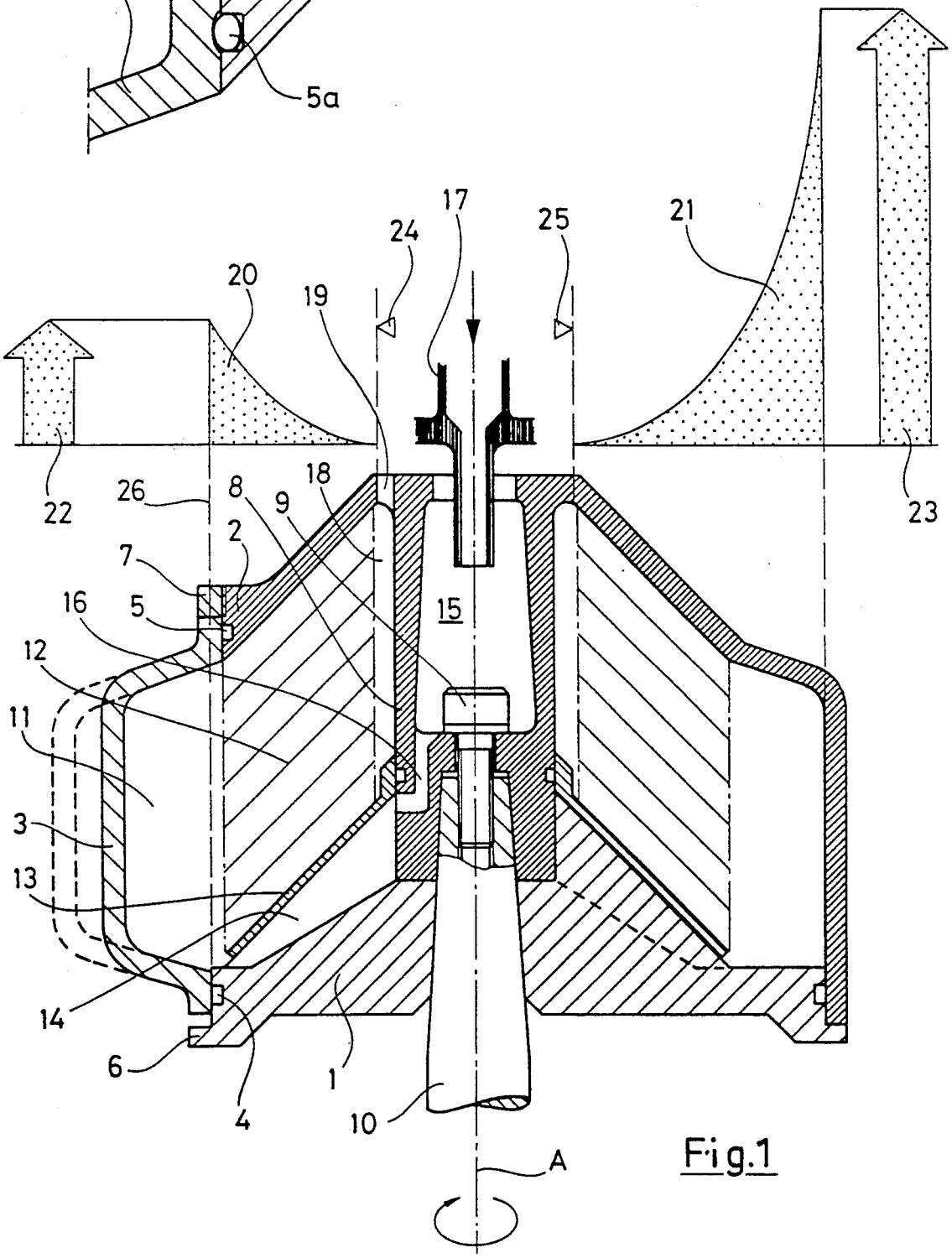
FIG. 1 illustrates a centrifugal separator showing a prior art configuration on the right-hand side and the instant invention on the left-hand side.

The drawing shows a centrifuge rotor intended for separation of small solids from a liquid. The centrifuge rotor is rotatable around a vertical axis A. To the right of the rotational axis A there is shown a rotor design of a previously known kind and to the left of the rotational axis A there is shown a preferred embodiment of the invention. In the following a centrifuge rotor designed according to the invention is first described, after which a comparison is made between this and a centrifuge rotor designed according to previously known technique.

The centrifuge rotor according to the invention has a rotor body comprising a lower end wall 1, an upper end wall 2 and a surrounding wall 3 arranged axially between the end walls. The surrounding wall 3 is arranged to seal by means of annular gaskets 4 and 5 against the respective end walls 1 and 2 in a way such that a certain axial movement of the surrounding wall relative to the end walls is allowed under maintained sealing axial movements of the surrounding wall 3 are limited downwardly by an annular flange 6 of the end wall 1 and upwardly by a ring 7 threaded onto the radially outermost part of the end wall 2.

As can be seen from the drawing, the lower part of the surrounding wall 3, that is sealing against the end wall 1, has a somewhat larger diameter than the upper part of the surrounding wall 3 sealing against the end wall 2.

The upper end wall 2 has a central column 8 formed in one piece therewith and extending axially downwardly towards and to abutment against the lower end wall 1. The column 8 has the form of a hollow cylinder. A screw 9 is arranged to keep the column 8 and the lower end wall 1 axially together and to retain the whole rotor body on the upper part of a vertical drive shaft 10.

Within the rotor body there is delimited a separation chamber 11 in which a stack of frusto-conical separation discs 12 is arranged coaxially with the rotor. The stack of separation discs rests on a conical partition 13 which in turn rests on the lower end wall 1. Between the end wall and the partition 13 there are delimited a number of radial channels 14 distributed around the rotor axis A and formed by a groove in the end wall 1. The channels 14 communicate at their radially outer ends with the separation chamber 11.

The hollow column 8 forms an inlet chamber 15 which via passages 16 through the lower part of the column 8 communicates with the radially inner ends of the channels 14. A stationary inlet pipe 17 extends axially into the inlet chamber 15.

Radially between the column 8 and the inner edges of the separation discs 12 there is formed one annular channel or several axially extending channels 18. A number of through holes 19 in the upper end wall 2 communicate with the channels 18 and form an outlet of the separation chamber for liquid separated therein.

The above described centrifuge rotor is intended to operate in the following manner.

A liquid containing particles having a larger density than the liquid is supplied during rotor operation through the inlet pipe 17 into the inlet chamber 15. Thence liquid is conducted through the channels 16 and 14 into the separation chamber 11 and therein through the interspaces between the separation discs 12 radially inwardly.

In the separation chamber 11 the solid particles move as a consequence of the centrifugal force radially outwardly, whereas liquid freed from particles flows radially inwardly and leaves the separation chamber through the axial channels 18 and the holes 19 in the end wall. The holes 19 form so called overflow outlets from the separation chamber 11.

The solids are collected and deposit on the inside of the surrounding wall 3.

At a suitable point of time or when a certain amount of particles have deposited on the surrounding wall 3 the supply of liquid through the inlet pipe 17 is interrupted and the rotor is stopped. After that the inlet pipe 17 and the ring 7 are removed, so that the surrounding wall 3 can be lifted up and separated from the other parts of the rotor.

After the inside of the surrounding wall 3 has been cleaned from separated solids (sludge) the surrounding wall is again mounted on the rotor and separation can be resumed. The separation discs 12 need not be disassembled in connection with the cleaning operation.

In the upper part of the drawing figure there are shown two diagrams 20, 21 and two vertical arrows 22, 23. The level of the free liquid surface formed in the separation chamber 11 during operation of the centrifuge rotor, i.e. the radial level of the overflow outlets 19, is illustrated by two triangles 24, 25.

In the left diagram it is illustrated how the liquid pressure within the separation chamber 11 grows radially outwardly from the level 24 of the free liquid surface to a radial level 26, at which the lower part of the surrounding wall 3 seals against the end wall 1. The arrow 22 thus illustrates the size of the axial liquid pressure acting on the rotor body at the level 26.

The liquid pressure prevailing radially inside the level 26 acts axially against the two end walls 1 and 2 and thus causes an axial force which has to be taker up by the screw 9 for keeping the end walls axially together. Radially outside the level 26 the liquid pressure in the separation chamber 11 only acts on the surrounding wall 3, radially as well as axially. Due to the fact that a certain axial movement is allowed by the axially outermost parts of the surrounding wall 3 relative to the end walls 1 and 2 a certain elastic deformation of the surrounding wall 3 as a consequence of the liquid pressure in the separation chamber can be allowed without this causing a further load on the screw 9. The axial forces to which the surrounding wall 3 is subjected by the liquid pressure radially outside the level 26 are thus taken up completely by the surrounding wall itself.

It is indicated by dotted lines that the surrounding wall 3 with unchanged dimensions in the areas in which it seals against the end walls 1 and 2 may have different dimensions axially between these areas. Such a different shape of the surrounding wall 3 does not influence the axial load to which the screw 9 will be subjected during operation of the centrifuge rotor. By use of the same end walls 1 and 2, the same stuck of separation discs 12 and the same screw 9 the centrifuge rotor thus may be provided with surrounding walls of different shape, allowing collection of a larger or smaller amount of solids in the separation chamber.

To the right of the rotor axis A there is shown a rotor design of a previously known kind. As can be seen in this case the upper end wall of the rotor body is formed in one piece with the surrounding wall of the rotor body. Furthermore, the surrounding wall and the lower end wall are formed such that they seal against each other at the largest inner diameter of the surrounding wall.

In this case, during rotor operation, each of the two end walls will be subjected to an axial liquid pressure all the way from the level 25 of the free liquid surface in the separation chamber and out to the radially outermost part of the separation chamber. The arrow 23 illustrates the size of the liquid pressure in the radially outermost part of the separation chamber.

This means that a member keeping the rotor body together—such as the screw 9—will be loaded by a substantially larger axial force in a rotor design of the previously known kind (to the right in the drawing)

than in a rotor design according to the invention (to the left in the drawing).

Irrespective of the kind of central means used for keeping the rotor body axially together the invention thus brings with it an advantage concerning the dimensioning of this means. The invention is particularly advantageous if the means in question has to be made very small for various reasons, e.g. as shown in the drawing in the form of a screw having a small diameter and being threaded into the end portion of a thin drive shaft.

In the above described embodiment of the invention a locking ring 7 has been used as a means for limiting axial movement of the surrounding wall 3 upwardly during rotor operation. Other more simple means doing the same thing can of course be used. Particularly, if the surrounding wall has substantially the same inner diameter in both of the areas in which it seals against the end walls 1 and 2, said means for limiting the axial movement of the surrounding wall may be made very simple, since in this case they will not be subjected to any substantial axial load from the surrounding wall 3 during rotor operation.

If desired, said means, e.g. the locking ring 7, may be produced in one piece with the surrounding wall 3, since the rotor design according to the invention only presumes that the surrounding wall 3 has an axial movability relative to one of the end walls.

FIG. 2 shows a particular embodiment of said means for limiting the axial movement of the surrounding wall 3*a* relative to the end wall 2*a*. Here use has been made of an annular gasket 5*a*, preferably made of rubber or some other elastic material, which during operation of the centrifuge rotor is allowed to expand radially outwardly—influenced by the centrifugal force—from a position in a first annular groove formed in a radially outward directed surface of the end wall 2*a* partly into a second annular groove formed in a radially inward facing surface of the surrounding wall 3*a*.

As long as the centrifuge rotor does not rotate, the gasket 5*a* thus will be retained in its groove in the end wall 2*a*, in which it admits free axial movement of the surrounding wall 3*a* relative to the end wall 2*a*, but during operation of the centrifuge rotor the gasket 5*a* will be in a radially expanded state in a position as illustrated in FIG. 2. In the latter position it allows a certain small axial movement of the surrounding; wall 3*a* relative to the end wall 2*a*, but the surrounding wall 3*a* can not remove itself completely from the end wall 2*a* without the gasket 5*a* being sheared to pieces.

We claim:

1. A centrifugal separator comprising: a rotor body rotatable about an axis and forming a separation chamber, the rotor body comprising two axially separated end walls and a surrounding wall situated axially between the end walls; a stack of conical separation discs arranged between the end walls in the separation chamber and coaxially with the rotor; and fastening means arranged to keep the end walls and the stack of separation discs axially together, the surrounding wall being formed separate from the fastening means and the end walls and being sealed at two respective areas against the end walls, the surrounding wall further having a smaller inner diameter in both of said areas in which it seals against the end walls that it has in an area axially between these said areas, and the surrounding wall during rotor operation bring free to move axially relative to at least one of the end walls in the area of its sealing thereagainst.

2. A centrifugal separator according to claim 1 wherein the surrounding wall has substantially the same inner diameter in both of the areas in which it seals against the end walls.

3. A centrifugal separator according to claim 2, wherein the surrounding wall is releasable from both said end walls by being axially displaceable relative thereto when the centrifugal separator is out of operation.

4. A centrifugal separator according to claim 3, wherein the separation discs are frusto-conical and have radially inner and radially outer edges, and said fastening means extends between the end walls radially inside the inner edges of the separation discs.

5. A centrifugal separator according to claim 2, wherein the separation discs are frusto-conical and have radially inner and radially outer edges, and said fastening means extends between the end walls radially inside the inner edges of the separation discs.

6. A centrifugal separator according to claim 2, wherein said fastening means comprises at least one first member that is permanently connected with one said end wall and extends axially through the stack of separation discs, and one releasable second member arranged to removably connect another one of said end walls with the first member.

7. A centrifugal separator according to claim 1, wherein the rotor body is supported by a drive shaft that is connected with one said end wall, and the surrounding wall has a larger inner diameter in the area of its sealing against said end wall than in the area of its sealing against another one of said end walls.

8. A centrifugal separator according to claim 7, wherein the surrounding wall is releasable from both said end walls by being axially displaceable relative thereto when the centrifugal separator is out of operation.

9. A centrifugal separator according to claim 8, wherein the separation discs are frusto-conical and have radially inner and radially outer edges, and said fastening means extends between the end walls radially inside the inner edge of the separation discs.

10. A centrifugal separator according to claim 7, wherein the separation discs are frusto-conical and have radially inner and radially outer edges, and said fastening means extends between the end walls radially inside the inner edges of the separation discs.

11. A centrifugal separator according to claim 7, wherein said fastening means comprises at least one first member that is permanently connected with one said end wall and extends axially through the stack of separation discs, and one releasable second member arranged to removably connect another one of said end walls with the first member.

12. A centrifugal separator according to claim 1, wherein the surrounding wall is releasable from both said end walls by being axially displaceable relative thereto when the centrifugal separator is out of operation.

13. A centrifugal separator according to claim 12, wherein the separation discs are frusto-conical and have radially inner and radially outer edges, and said fastening means extends between the end walls radially inside the inner edges of the separation discs.

14. A centrifugal separator according to claim 12, wherein said fastening means comprise at least one first member that is permanently connected with one said end wall and extends axially through the stack of separation discs and one releasable second member arranged to removably connect another one of said end walls with the first member.

15. A centrifugal separator according to claim 1, wherein the separation discs are frusto-conical and have radially inner and radially outer edges, and said fastening means extends between the end walls radially inside the inner edges of the separation discs.

16. A centrifugal separator according to claim 15, wherein said fastening means comprises at least one first member that is permanently connected with one said end wall and extends axially through the stack of separation discs, and one releasable second member arranged to removably connect another one of said end walls with the first member.

17. A centrifugal separator according to claim 1, wherein said fastening means comprises at least one first member that is permanently connected with one said end wall and extends axially through the stack of separation discs, and one releasable second member arranged to removably connect another one of said end walls with the first member.

18. A centrifugal separator according to claim 17, wherein the rotor body is supported by a vertical driving shaft and said releasable second member comprises a screw that is threaded into an axial hole in the driving shaft for retaining the rotor body thereon.

* * * * *